United States Patent [19]

Lenz

[11] Patent Number: 4,947,646

[45] Date of Patent: Aug. 14, 1990

[54] RADIAL VANE HYDRAULIC MACHINE

[76] Inventor: Erwin Lenz, 180 Cabrini Blvd., New York, N.Y. 10033

[21] Appl. No.: 240,036

[22] Filed: Sep. 2, 1988

[51] Int. Cl.[5] ..... F04C 2/344

[52] U.S. Cl. ..... 60/484; 418/147; 418/256; 418/259; 418/269

[58] Field of Search ..... 418/147, 256, 259, 265, 418/269, 145, 146, 148; 180/308; 60/484

[56] References Cited

U.S. PATENT DOCUMENTS

| | | | |
|---|---|---|---|
| 1,467,209 | 9/1923 | Sumner | 418/147 X |
| 1,488,729 | 4/1924 | Ballay | 418/265 X |
| 1,697,924 | 1/1929 | Lusso | 418/265 X |
| 2,458,620 | 1/1949 | Megeber | 418/147 |
| 2,590,132 | 3/1952 | Scognamillo | 418/265 X |
| 2,731,920 | 1/1956 | Scognamillo | 418/256 X |
| 3,011,449 | 12/1961 | Ernst | 418/269 X |
| 3,301,232 | 1/1967 | Eickmann | 418/147 |
| 4,020,917 | 5/1977 | Lutterschmidt | 180/308 |
| 4,069,886 | 1/1978 | Campbell et al. | 180/308 |

FOREIGN PATENT DOCUMENTS

| | | | |
|---|---|---|---|
| 497452 | 11/1953 | Canada | 418/256 |
| 369575 | 2/1923 | Fed. Rep. of Germany | 418/147 |
| 1919893 | 11/1969 | Fed. Rep. of Germany | 418/259 |
| 239833 | 10/1986 | Fed. Rep. of Germany | 418/259 |
| 737238 | 10/1932 | France | 418/269 |
| 934566 | 1/1948 | France | 418/265 |
| 161102 | 12/1979 | Japan | 418/259 |
| 60288 | 4/1985 | Japan | 418/269 |
| 194035 | 3/1923 | United Kingdom | 418/147 |

*Primary Examiner*—Edward K. Look
*Assistant Examiner*—George Kapsalas
*Attorney, Agent, or Firm*—Barry G. Magidoff

[57] ABSTRACT

There is provided a positive displacement hydraulic rotator unit capable of operating in either direction of rotation. The rotator unit comprises a housing defining a substantially cylindrical internal chamber centered about a first central axis, and a rotor within the chamber. The rotor is rotatably mounted about a second axis, parallel to the first axis but radially displaced. There are intake and exhaust openings into the chamber, angularly displaced about and through the cylindrical surface. The rotor comprises a substantially rigid core having at least three radially extending, centrally interconnected channels for slidably holding rigid elongated blades. The blades are in turn interconnected by a rigid member so that the rigid member and the blades rotate and move radially as a single unit. The radially outwardmost end of each blade forms a seal with the cylindrical surface and the sides of each blade forms seals with the end walls of the chamber, so as to divide the internal chamber into sealed sections. The blades and the inlet and exhaust openings are so placed that the two openings are always separated by at least one rotor blade. A shaft for providing mechanical energy is secured to the center of the rotor core. The rotator unit can most effectively be used as part of a closed loop hydraulic system, for example, for providing the driving force for a wheeled vehicle.

14 Claims, 16 Drawing Sheets

FIG. 7
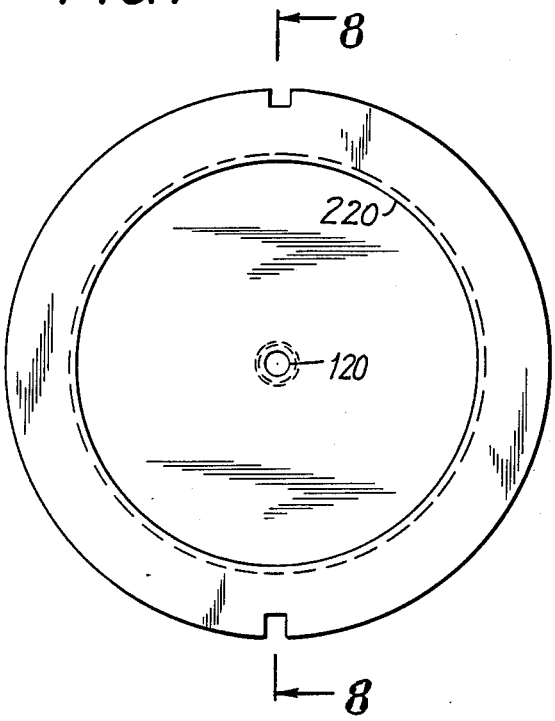
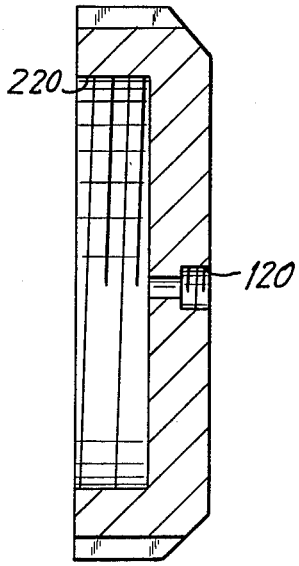
FIG. 8

RADIAL VANE HYDRAULIC MACHINE

BACKGROUND OF THE INVENTION

This invention is directed to a rotary fluid drive unit and most specifically a hydraulic motor system comprising positive displacement rotors impelled by a closed hydraulic fluid loop.

Hydraulic motors, including rotary hydraulic motors, have previously been suggested, for example, for driving automobiles or other wheeled vehicles. See for example, U.S. Pat. No. 2,421,013 to Cornwell.

SUMMARY OF THE INVENTION

In accordance with the present invention, there is provided a rotary fluid drive unit comprising a closed chamber having an internal, cylindrical surface centered about a first central axis, and an inlet opening and an exhaust opening into the chamber through the cylindrical surface, the inlet and the outlet openings being angularly circumferentially displaced about the cylindrical surface; and a rotor, rotatably mounted within the chamber and rotatable around a second axis radially displaced from the first central axis; the rotor comprising a rigid core having an outer diameter less then that of the chamber, and a plurality of blade members slidably mounted into the core and extending towards the cylindrical surface; and a sealing shoe pivotably and sealingly mounted to the radially outward end of each blade member so as to be substantially in continuous sealing contact with the internal cylindrical surface as the rotor rotates; and a mechanical force-conducting member secured to the core and extending outwardly from the chamber coaxially with the core, the mechanical force-conducting member rotating with the core to transmit mechanical energy. The inlet and the outlet openings are located in the portion of the cylindrical surface closer to the second axis, and are separated by an angle of less than 180° relative to the circumference of the rotator core, such that at least one rotor blade, extending to the cylindrical surface, is at all times located between the inlet and outlet openings The various parts of the rotor fit together within the chamber sufficiently closely such that a volume within the chamber defined between two adjacent blade members, the cylindrical surface and the rotor, is substantially out of fluid pressure connection with a chamber volume angularly beyond the defining blade members.

The blade members rotate together with the other parts of the rotor. However, the blade members also continuously reciprocate in a radial direction relative to the core of the rotor, in order to maintain the sealing shoe surfaces in contact with the cylindrical surfaces. The blade members must be functionally interconnected, such that radially inward movement of one or two of the blades causes radially outward movement of at least another one of the blades.

Preferably, there is provided a rigid member pinned to all of the blades. The blades are slidably secured within channels through the core, extending radially inwardly from the outer circumference of the core, the channels being centrally interconnected within the core. The blades are thus maintained in a suitable spatial relationship to each other and towards the cylindrical surface, such that the sealing surface at the end of each blade is maintained constantly in contact with the cylindrical surface. As the rotor rotates, and a radially inward force is exerted between the sealing surface of one blade and the cylindrical surface, tending to move that blade radially towards the second axis (or the rotor core), the rigid member transmits such force and tends to move at least one of the other blades away from the second axis, or the rotor core.

When mechanical energy is to be generated by the rotor of the present invention, pressurized fluid enters the inlet to the chamber causing rotation of the rotator, and thus of the mechanical force-conducting member, as a result of the pressure exerted against the pressure side of one blade. With rotation, there is an initial expansion of the internal volume open to the inlet between two adjacent blades. Preferably, there are three sliding blades secured to the core, dividing the chamber into three volumetric sections. Although the blades are evenly distributed circumferentially relative to the rotor, as the core rotates within the chamber, the blades move eccentrically relative to the cylindrical surface; the shoes on each blade, pressed against the internal cylindrical surface, cut off changing arc lengths relative to the internal cylindrical surface. As the core rotates, the blades move radially with respect to the core, and maintain an even, continuous sealing pressure against the circumferential surface, as a result of the action of the pinned rigid member.

The rotary fluid drive system in accordance with the present invention can be utilized for the driving of moving vehicles, and can also be utilized for providing stationary power as in factories, among other uses. The fluid drive system of the present invention is actually superior to electric power as a driving source, as it is more compact and can be directly linked to the driven unit without the intermediate gearing necessary to reduce the rotary velocity of an electric motor, i.e., without stepdown gear transmission being required. Furthermore, this hydraulic system does not generate the high frequency vibrations of an electric motor.

BRIEF DESCRIPTION OF THE DRAWINGS

The drawings attached hereto are submitted to depict a preferred embodiment of the present invention. This embodiment exemplifies, and is not to be considered exclusive of, the scope of the present invention. In certain portions, the drawings may be schematic so as to reflect the conventional nature of that portion of the system.

Referring to the drawings,

FIG. 7 is a front view of the cap for the rear end housing section of the embodiment of FIG. 1;

FIG. 8 is a radial section of the element of FIG. 7 taken along lines 8—8;

DETAILED DESCRIPTION OF THE PREFERRED EMBODIMENTS

Figure 1:
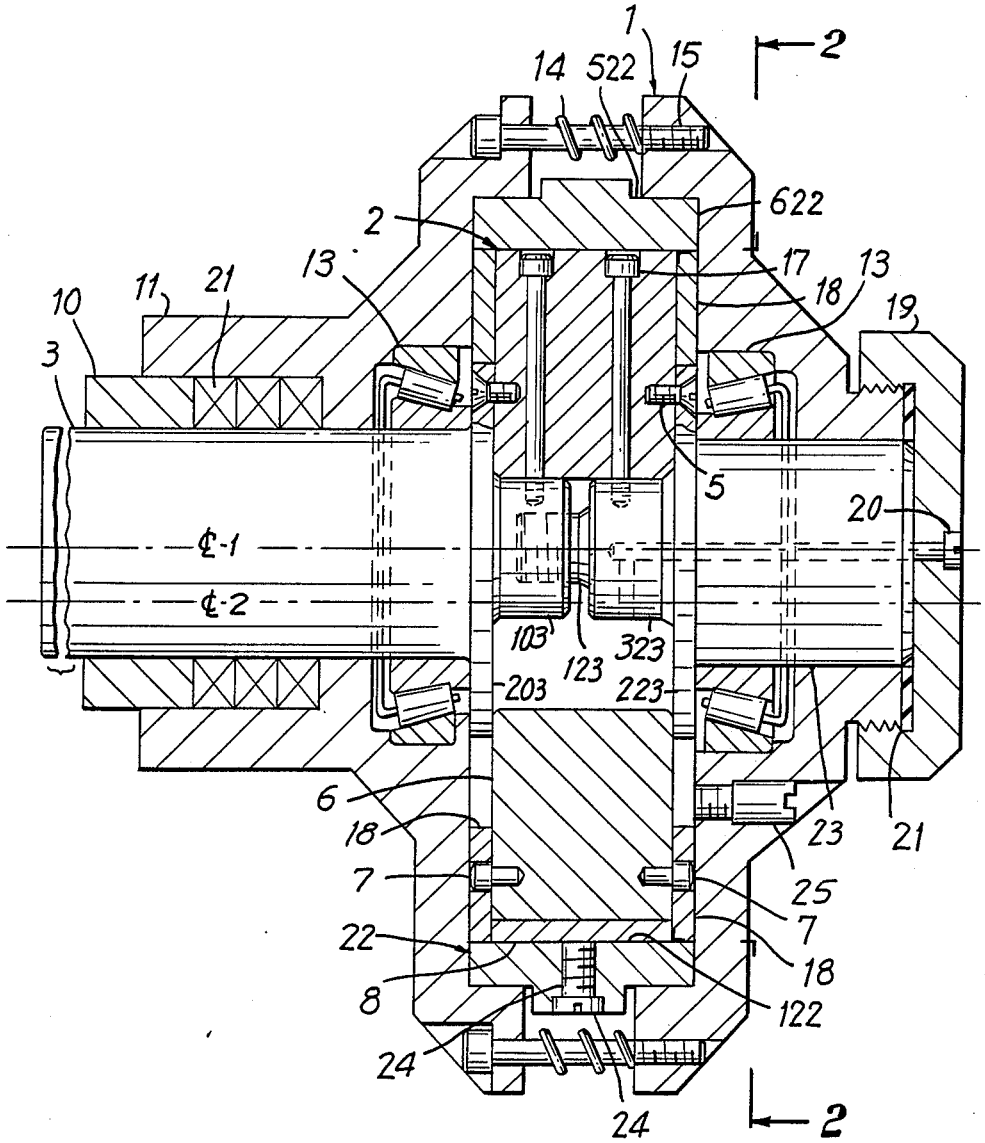
FIG. 1 is a longitudinal cross-sectional view of a rotary unit in accordance with the present invention.
Figure 2:
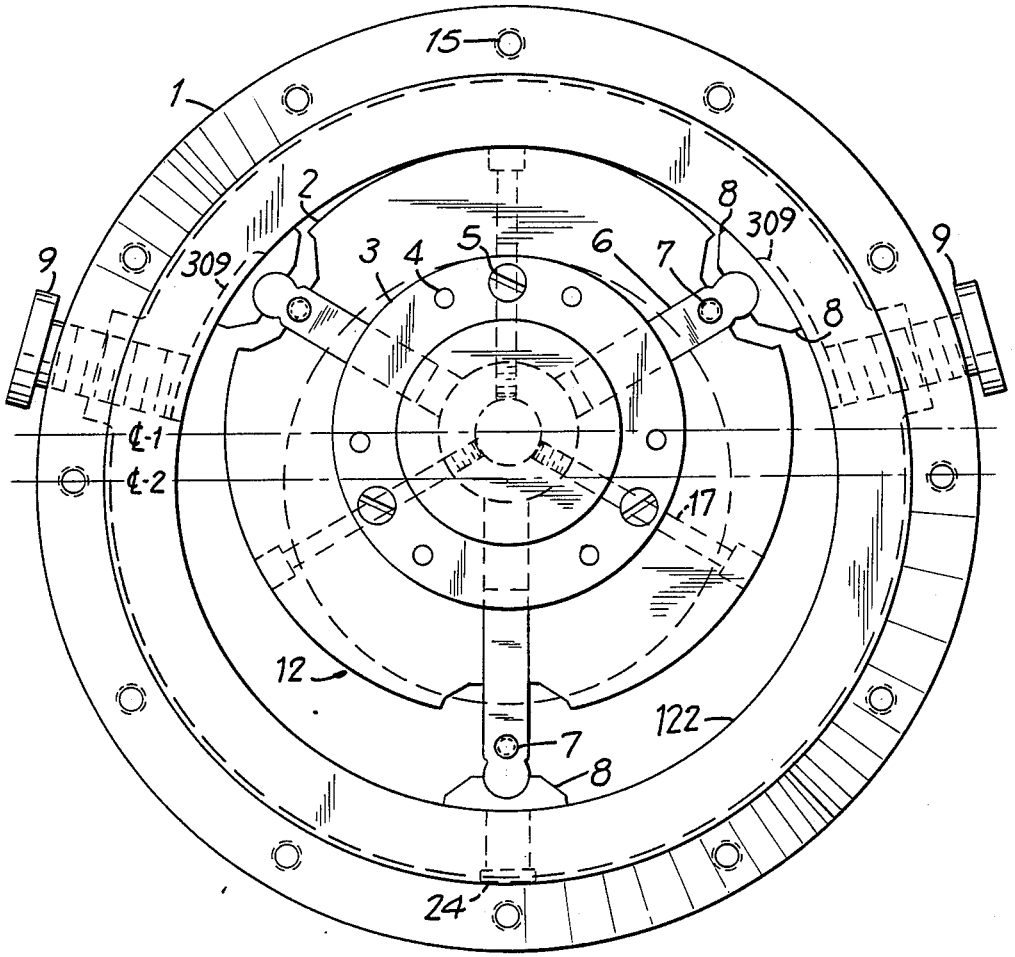
FIG. 2 is a rear view with the cover and ring plate removed, along lines 2—2 of FIG. 1.
Figure 2A:
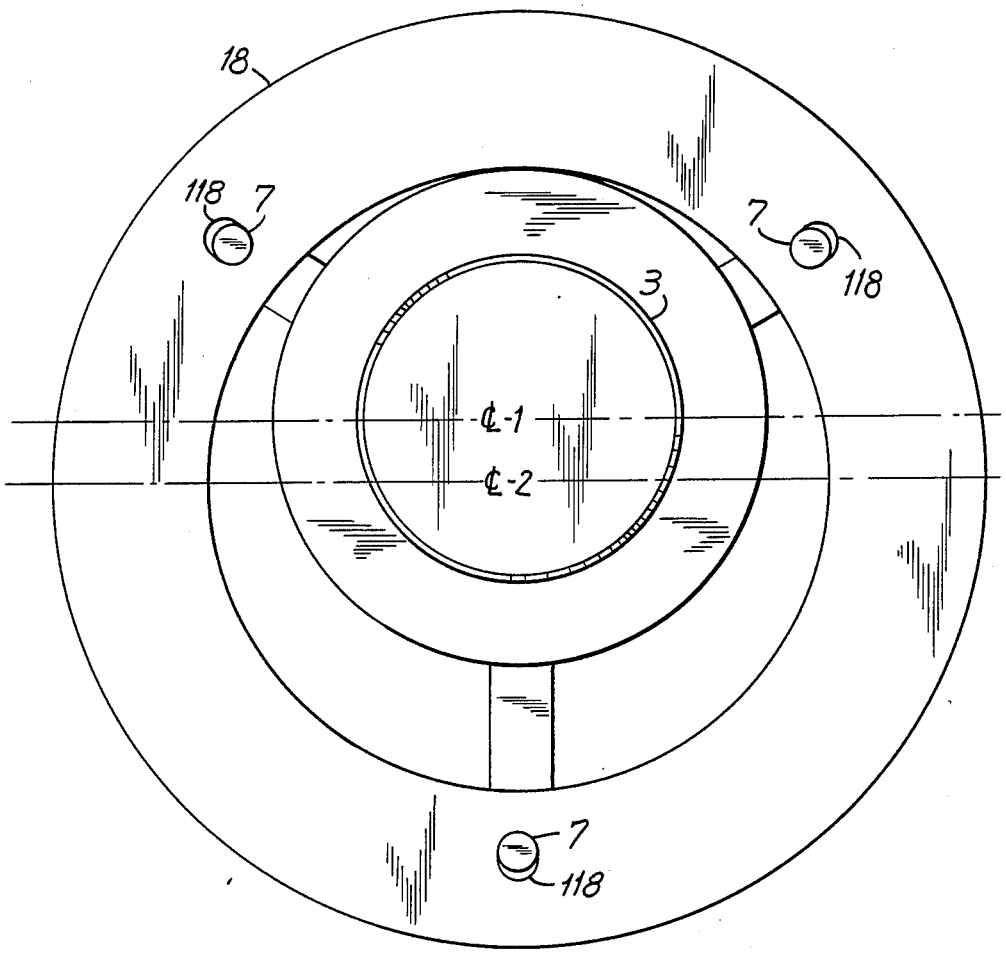
FIG. 2*a* is an enlarged front view of the rotor of the present invention, with the casing removed.
Figure 3:
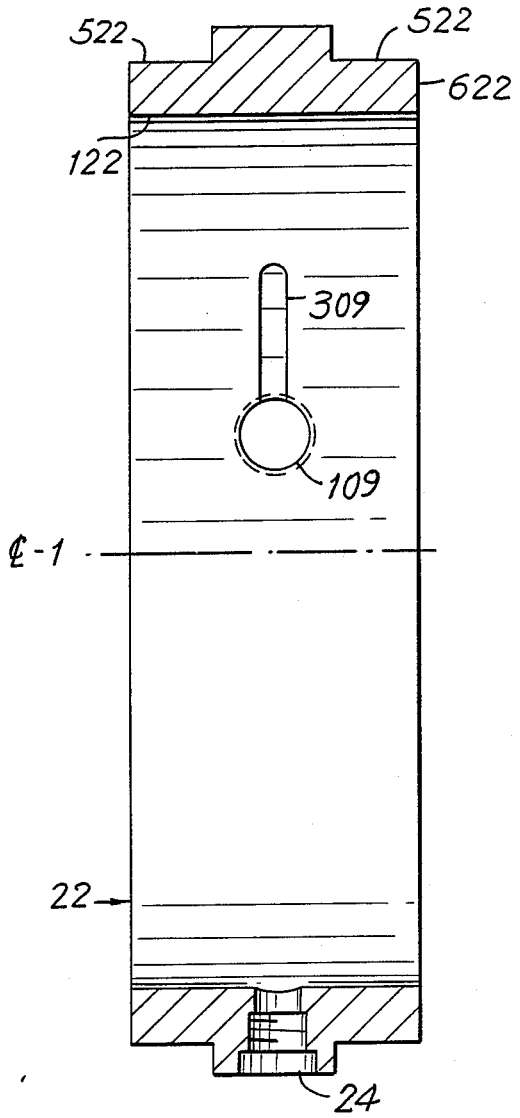
FIG. 3 is a radial cross-section of the central portion of the housing of the rotary drive of the embodiment of FIG. 1.
Figure 4:
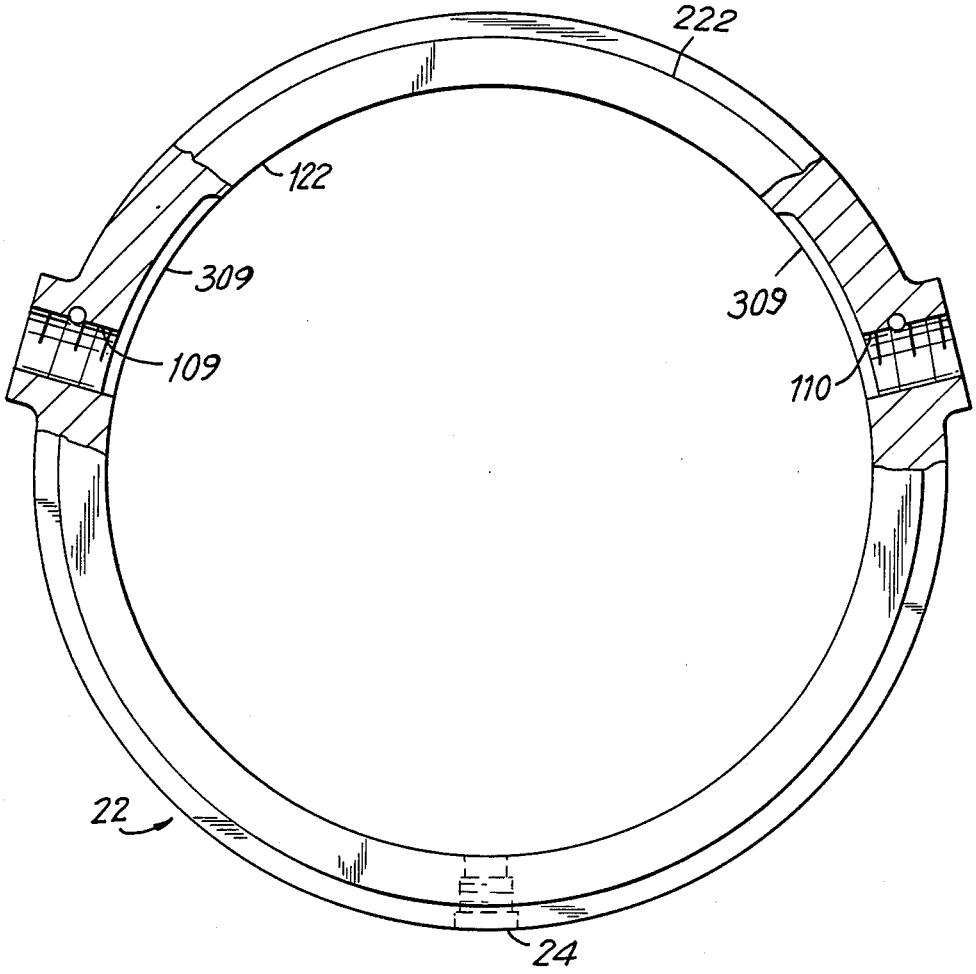
FIG. 4 is a partially cut-away side view of the central housing portion of FIG. 3 showing the inlet and outlet.
Figure 6:
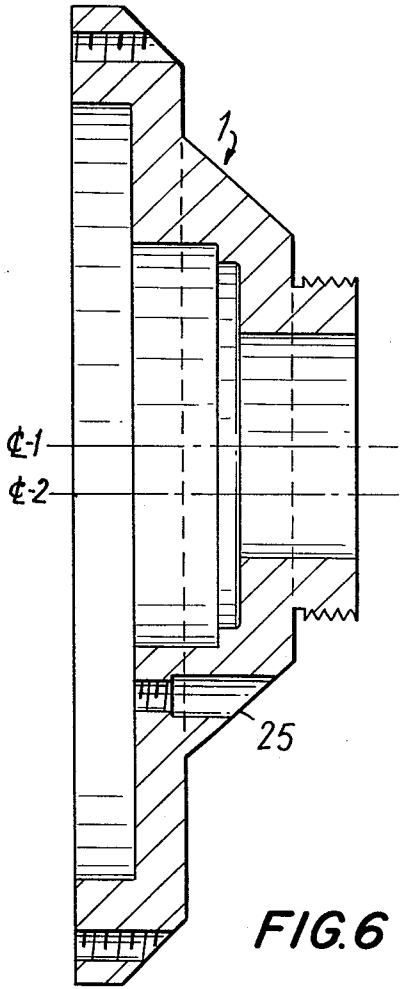
FIG. 6 is a cross-sectional view taken along lines A—A of FIG. 5.
Figure 5:
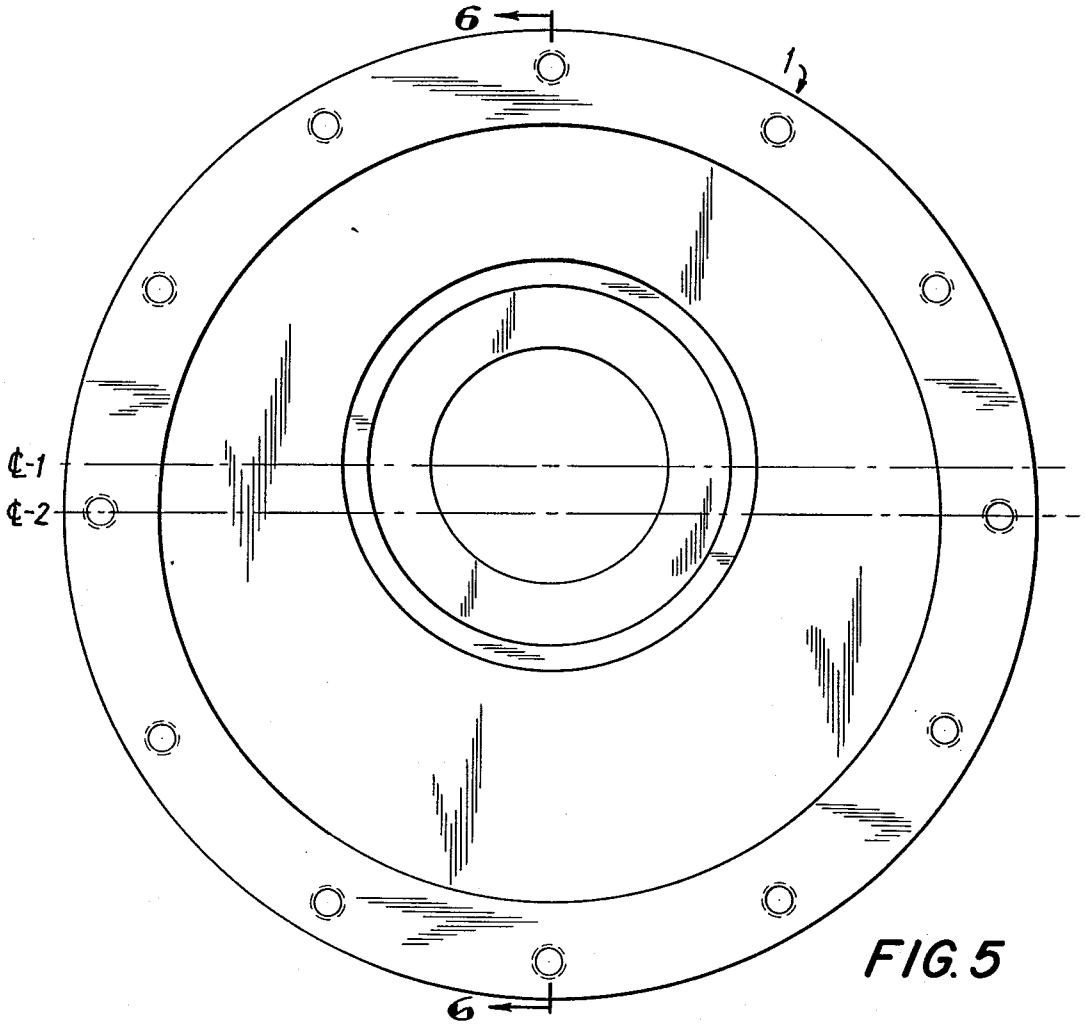
FIG. 5 is a front view of the rear end housing section of the embodiment of FIG. 1.
Figure 10:
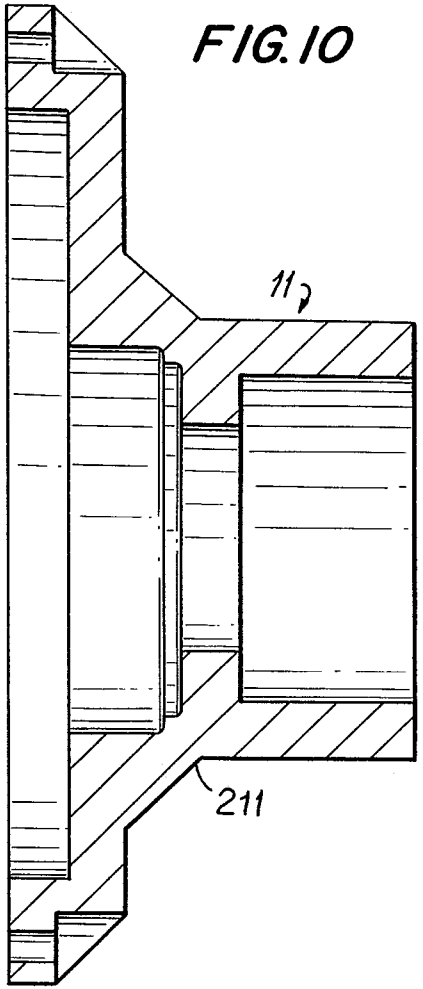
FIG. 10 is a cross-sectional view taken along lines B—B of FIG. 9.
Figure 9:
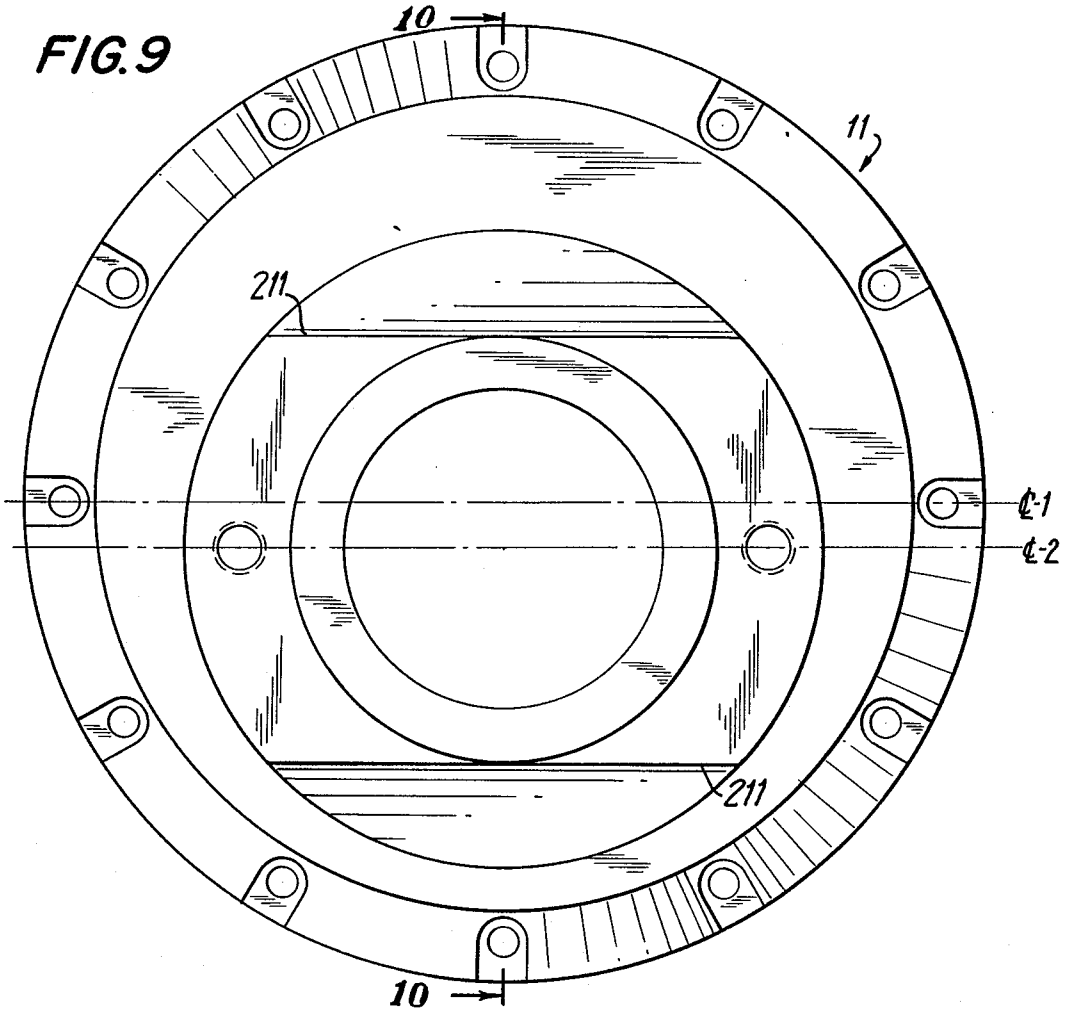
FIG. 9 is a front view of the front end section of the housing of the embodiment of FIG. 1.
Figure 12:
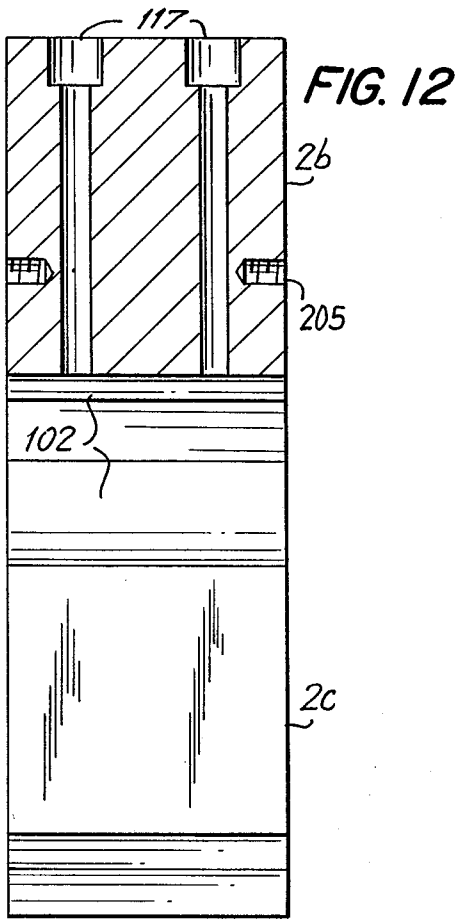
FIG. 12 is a cross-section view of the core sections taken along lines C—C of FIG. 11.
Figure 11:
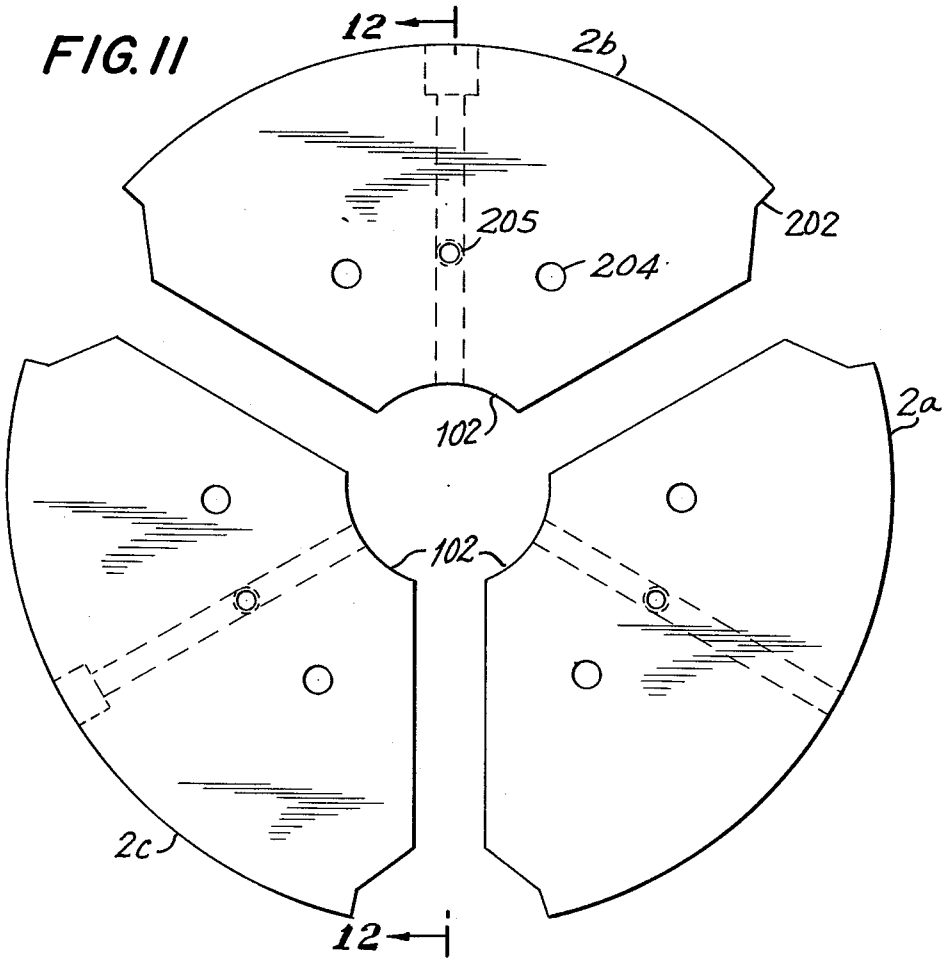
FIG. 11 is an enlarged view of the unconnected core sections of the rotor of the present invention.
Figure 13:
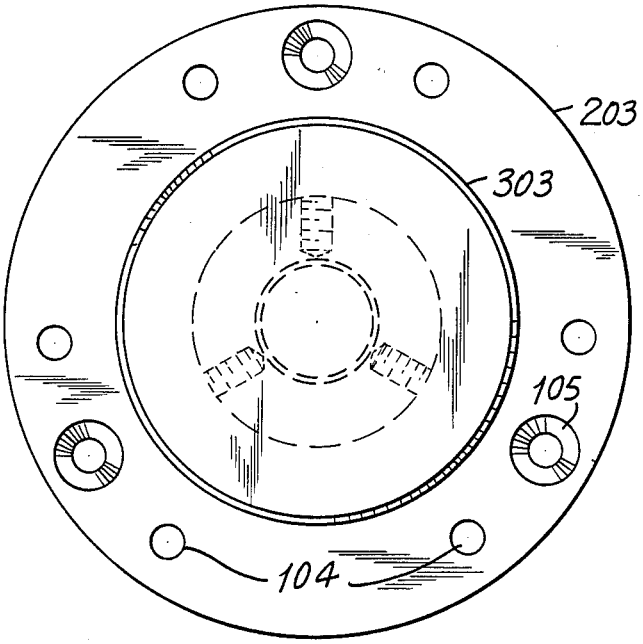
FIG. 13 is an enlarged end view of a portion of the force transmitting front axle member of the embodiment of FIG. 1.
Figure 14:
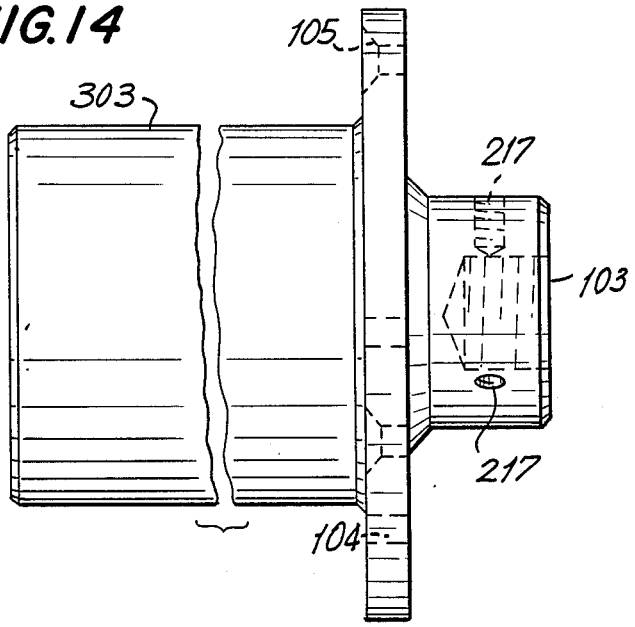
FIG. 14 is a side view of the member of FIG. 13.
Figure 15:
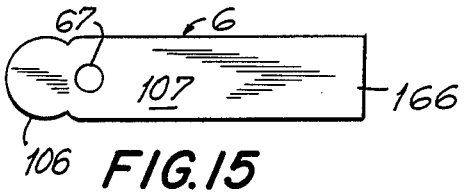
FIG. 15 is an enlarged front view of a blade for the rotator of the embodiment of FIG. 1.
Figure 16:
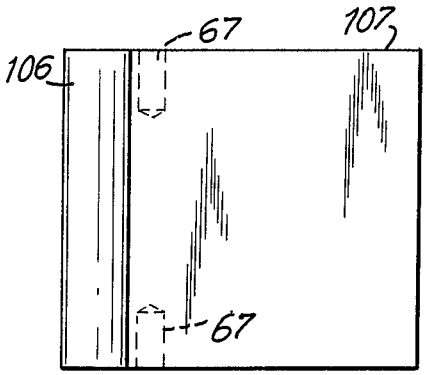
FIG. 16 is a side view of the blade of FIG. 15.
Figure 17:
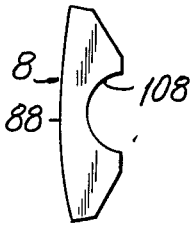
FIG. 17 is an enlarged front view of a blade shoe of the embodiment of FIG. 1 of the present invention.
Figure 18:
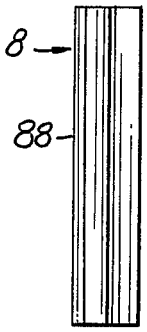
FIG. 18 is a side view of the shoe of FIG. 17.
Figure 20:
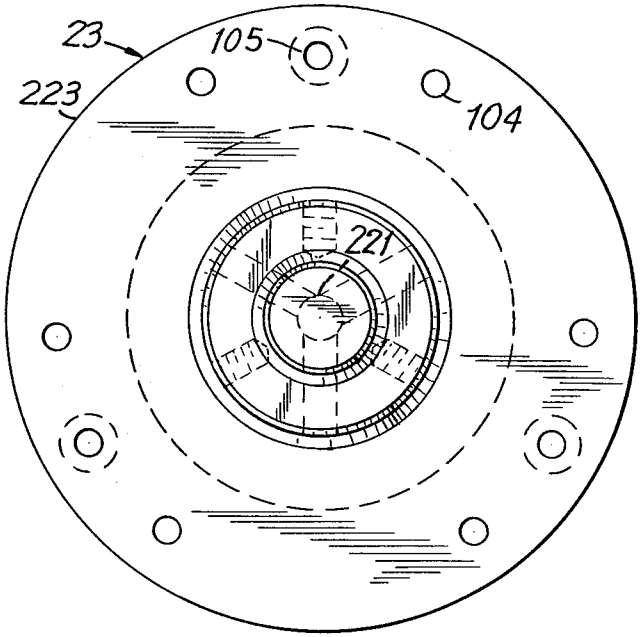
FIG. 20 is the front view of the member of FIG. 19.
Figure 19:
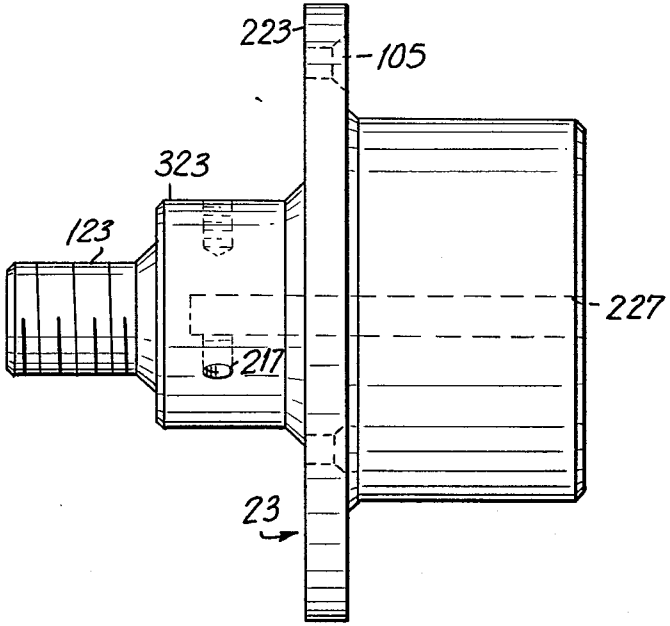
FIG. 19 is an enlarged side view of the rear portion of the axle member of the embodiment of FIG. 1.
Figure 22:
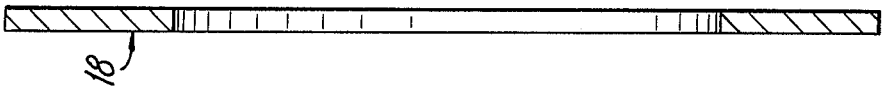
FIG. 22 is a cross-section view of the ring of FIG. 21.
Figure 21:
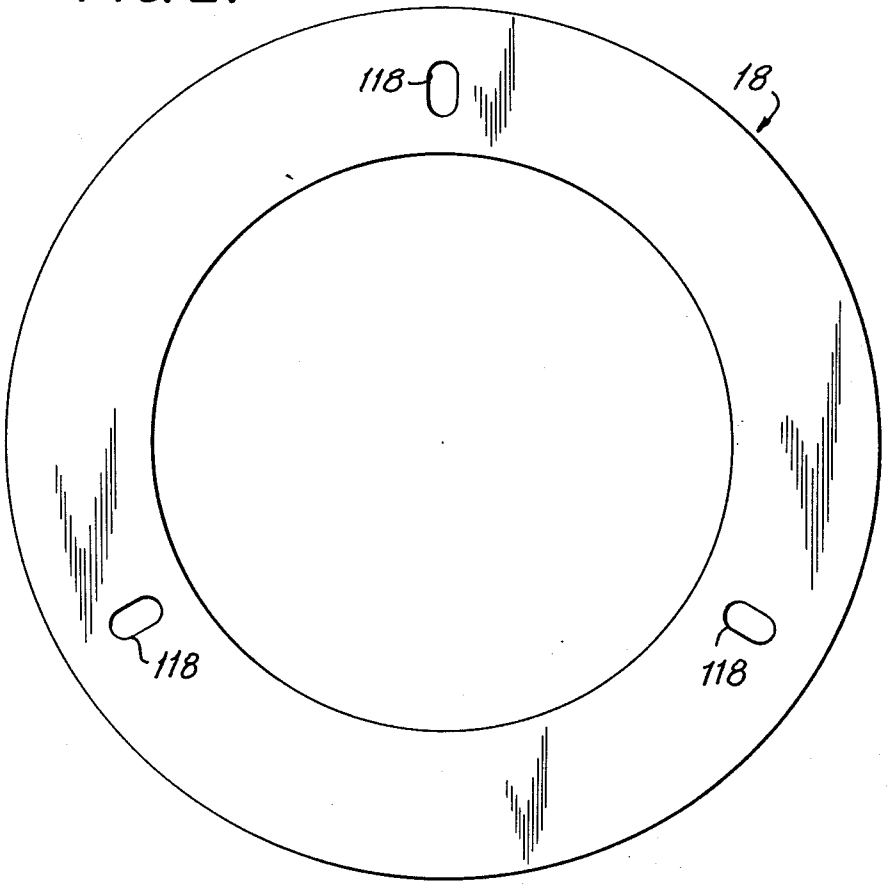
FIG. 21 is an enlarged front view of a blade-connecting ring plate of the embodiment of FIG. 1.

Referring to the drawings, the present invention is depicted in a preferred combination comprising a single fluid pressure rotator driver (generally indicated by the numeral 100) in fluid flow connection with a plurality (four in number) of fluid pressure motors, or followers (generally indicated by the numeral 200), in the combination which would be utilized for the four-wheel drive operation of a motorized vehicle. In this case, the rotary drive unit 100 and the driven motor units 200 are of substantially identical design, albeit the driver power unit 100 is of larger volumetric capacity. However, a detailed description of any of these units will suffice to understand the construction and operation of all of the units.

The driver unit, generally indicated by the numeral 100, is of the rotating positive displacement type and in its construction provides a housing formed from a fixed cylindrical casing 22 and a front housing section 11 and a rear housing section 1. Within the housing there is journaled, eccentrically, a complex rotor, generally indicated by the numeral 12. Defined between the rotor 12 and the casing 22 is an arcuate working chamber, into which open two openings 109,110 serving as an inlet and an outlet, through the central cylindrical casing 22.

Slidably mounted in the rotor 12, for movement radially with respect to the rotor, are a plurality of rotor blades 6, preferably three in number; the rotator blades are provided at their outer circumferential ends with a curved head surface 106, which are in turn seated into a concave surface 108 on curved blade shoes 8. The outer surfaces 88 of the blade shoes are designed to sealingly wipe against the inner cylindrical surface 122 of the cylindrical casing 22. The rotor blades 6 are thus maintained indirectly in contact with the inner cylindrical surface 122 and sealably divide the working chamber into separate sealed arcuate sections. The movement of the working fluid through the working chamber is thus effected by the combination of the blades 6 (with the blade shoes 8) reciprocating, relative to the rotor core 2, and sealingly rotating within the casing.

The cylindrical casing 22, in the embodiment depicted in the drawings, is intended to be fixed against rotation, while the rotor 12 and rotator blades 6 rotate eccentrically therewithin.

A mechanical energy transferring, or drive, flanged shaft 3 is secured concentrically to and rotates with the rotor 12. The shaft 3 extends axially outwardly from the rotor 12 to transmit mechanical energy from or to the rotating fluid unit. The rotor 12 is supported within the casing 22 by the shaft 3.

Referring to the details of construction of the fluid drive units of the present invention, the casing is formed of three parts, a central casing section 22, a front output section 11, and a rear casing section 1. The front and rear housing sections 11, 1 are adjustably secured on and around the two shoulders 522 on the outer cylindrical edge of the central casing section 22 by spring-loaded casing bolts 15 distributed around the outer circumference of the front and rear casing sections; this permits adjustment of the running fit between the rings 18 and the shaft flanges 203, 223, and the internal surfaces of the front and rear casing sections 11, 1. The two shoulders 522 and the peripheral side surfaces 622 must be concentric with the inner cylindrical surface 122, and machined to be in continuing contact with the, also machined, mating surfaces of the front and rear casing sections 1,11.

The rotator 12 is rotatably journaled within the casing about an axis CL-1 radially displaced from the central axis CL-2 of the casing 22, with the blades 6 moving eccentrically relative to the rotor 22. The rotor 12 is held together as an integral unit, but is formed of three distinct core segments 2*a, b, c,* between which are slidably held the rotor blades 6.

Although, as shown, the rotor 12 is formed of several parts, the rotor core 2 must act as a single integral unit, with internal movement by the blades 6, during operation. The rotor 12 is constructed by first threadedly connecting the front shaft part 3 and the rear shaft part 23 by the male threaded end 123 and female threaded opening 103, respectively The male member threaded portion 123 is made slightly longer than the depth of the threaded female portion to leave a gap to permit fluid flow communication within the central open volume and behind the three blades 6. The three identical core sectors 2*a, b, c* (with the three identical blades 6 disposed between the core sectors), are placed between the shaft flanges 203, 223; the two shaft ends 123,103 are threadedly tightened so the flanges 203,223 exert pressure against the core sectors 2. There must be sufficient clearance with respect to the blades 6, however, to permit the blades 6 to be able to reciprocate radially relative to the flanges 203,223 and to the core sectors 2. Holes are then tapped into the core sectors 2*a, b, c* concentric to the holes in the flanges and the flanges 203, 223 are then secured to the core sectors by bolts 5; snug-fitting dowel pins 4 eliminate substantially all slack.

The blades 6 are all interconnected by the annular rotor ring plates 18 which surround the front and rear shaft flanges 203,223. The two annular rotor ring plates 18 are identical and have an internal diameter sufficiently greater than that of the shaft flanges 203,223, so as not to touch the flanges as the blades reciprocate. The thickness of each ring plate 18 and its respective flange 203,323, are substantially equal.

The two ring plates 18 are pinned to the front and rear edges 107 of the blades 6 by shoulder pins 7, extending into both edges 107 of each blade 6. The head of each shoulder pin 7 is held within the several elongated slots 118, equiangularly located through the rings 18, abut against the blade edge 107. The three blades 6 and the two ring plates 18 thus rotate together with the core 12, but must also move radially relative to the core 12. The slots 118 on the ring plates 18 are elongated in a radial direction, but their minor diameter provides a slidable fit for the heads of the pins 7.

To further insure stability of the rotor 12, the core sectors 2 are radially secured to the central shaft ends 103,123 utilizing the long threaded rotor bolts 17. As shown, there is a gap between the larger diameter inner shaft ends 103, 323 which permits the circulation of working fluid within the central portion of the core 12, to provide lubrication for uniform movement of the blades 6 as the rotor rotates eccentrically within the casing.

A central toroidal space is provided within the rotor, defined by the inner surfaces !02 of the core segments, the inner surfaces of the shaft flanges 203,223, the outer surfaces of the shaft ends 103,323, and the inward ends 166 of the three blades This central space provides communication between the fluid located radially behind each blade 6, i.e., in contact with the inward end 166, thus equalizing any pressure resistance which might otherwise be created by the radial movement of the blades 6.

The tightness of the fit between the various mating surfaces of the three casing sections 1,11,22 and the adjacent portions of the rotor rings 18 can be varied utilizing the series of spring-loaded peripheral bolts 15. The friction losses of the hydraulic units and their pressure-tightness can be varied by such adjustment.

The shaft outer sections 3, 23 are each supported by tapered roller bearings !3 within the front and rear casing sections, respectively. The rear casing 1 is sealed off by rear casing cap 19. The forward shaft 3, which extends to outside of the casing, passes through a stuffing box seal 21 at the outer forward end of the front casing section 11, thus providing a pressure seal for the interior of the fluid drive unit.

In operation, as the rotor 12 turns about its axis CL-1 within the casing 1,11,22, the blade shoes 8 are forced to follow the internal cylindrical surface 122, creating sealed off sections within the casing working volume. The sides of the blades provide a seal with the ring plates 18, which in turn seal against the interior of the front and rear housing casings 1,11. For example, if the unit is to act as a driver, fluid is taken in through inlet 109 at a relatively lower pressure, is pushed through the working space by the rotor and blades, and is exhausted at an advanced pressure through outlet 110. The hydraulic fluid can also act as the lubricant. When operating as a hydraulic driver, mechanical energy for operating the rotor can be provided via the front shaft 3.

To permit continuous inlet flow, a groove 309 is formed into the inner cylindrical surface 122 at the inlet 109. The length of the groove 309 is about twice the width of the sealing surface 88, such that when the sealing surface 88 is directly on the inlet 109, there continues to be a flow of fluid.

When operated as a fluid driven motor, pressurized fluid enters through inlet 109, exerting pressure against the rotor blades 6 and the shoes 8, causing rotation of the rotor 12; the fluid, at a lower pressure, exhausts through the outlet 110. Mechanical energy is transmitted from the rotor through the front shaft 3.

When starting up the system, operating fluid can be fed into the system through feed opening 25, or removed through drain opening 24. The system can be vented, or pressure within the system measured, through vent opening 20.

For purposes of this operation, a sufficient seal should be formed between the curved outer surface of the shoes 8 and the inner cylindrical surface 122 and between the sides of the front and rear housing sections 11,1 and the annular rings 18, to isolate the volume defined between two adjacent rotor blades 6. In the embodiment shown, there are three rotor blades. Although a greater number than three can be used, little advantage is to be gained. It is merely necessary that there always be at least one blade 6 separating the inlet opening 109 from the outlet opening 110.

As the rotor 12 rotates, the unitary portion of the rotor comprising blades 6 and the annular rings 18, moves radially towards and away from the rotor center. As shown, each rotor core section 2 has a cutout portion 202 at its edge, such that when a blade 6 is fully retracted the shoe 8 fits within the cutout portion such that the outer circumferential surface of the shoe 8 is substantially colinear with the outer circumferential surface of the adjacent cores 2.

It is recognized that for successful operation of this invention, when the rotor is turning, an absolute pressure-tight fit between the working volumes separated by the blades 6, is not necessary. A clearance of a few thousandths of an inch between the various surfaces, would not unduly disrupt the desired seal but would permit lubrication by the hydraulic fluid, significantly reducing friction and the difficulty of manufacture.

Preferably, the working fluid is a liquid having a sufficiently high viscosity to provide lubrication for the system. However, if desired, a gaseous material or a low viscosity liquid can be used as the driving fluid, with auxiliary lubrication being provided Useful such liquid materials include low molecular weight petroleum oils, silicone oils. Suitable gaseous fluids include, for example, carbon dioxide, nitrogen or air.

It has been found that the unit described above can be used either as a hydraulic system, in which case the transmission fluid will be a liquid, or as a gaseous pneumatic system, in which case the primary fluid will be gas. However, it has been found that in either case, there must be some liquid present, and when the unit is used with a gas as the operating fluid, a generally more viscous liquid, albeit in relatively small quantities should be present to act as a lubricant and to improve the sealing of the system.

When used as a hydraulic system, there is preferably at least a minor proportion of gas in the overall closed system, i.e., including the driver unit and the follower units. Preferably, at least about 5% of the volumetric capacity of each hydraulic unit should be a gas, when the principal hydraulic operating fluid is a liquid, to make the system more flexible. The gas is preferably a noncondensible gas, and both the gas and the transmission/lubricating liquid should be mutually substantially chemically inert with respect to each other and to the material of construction forming the internal exposed surfaces of each of the rotary fluid drive units.

Figure 25:
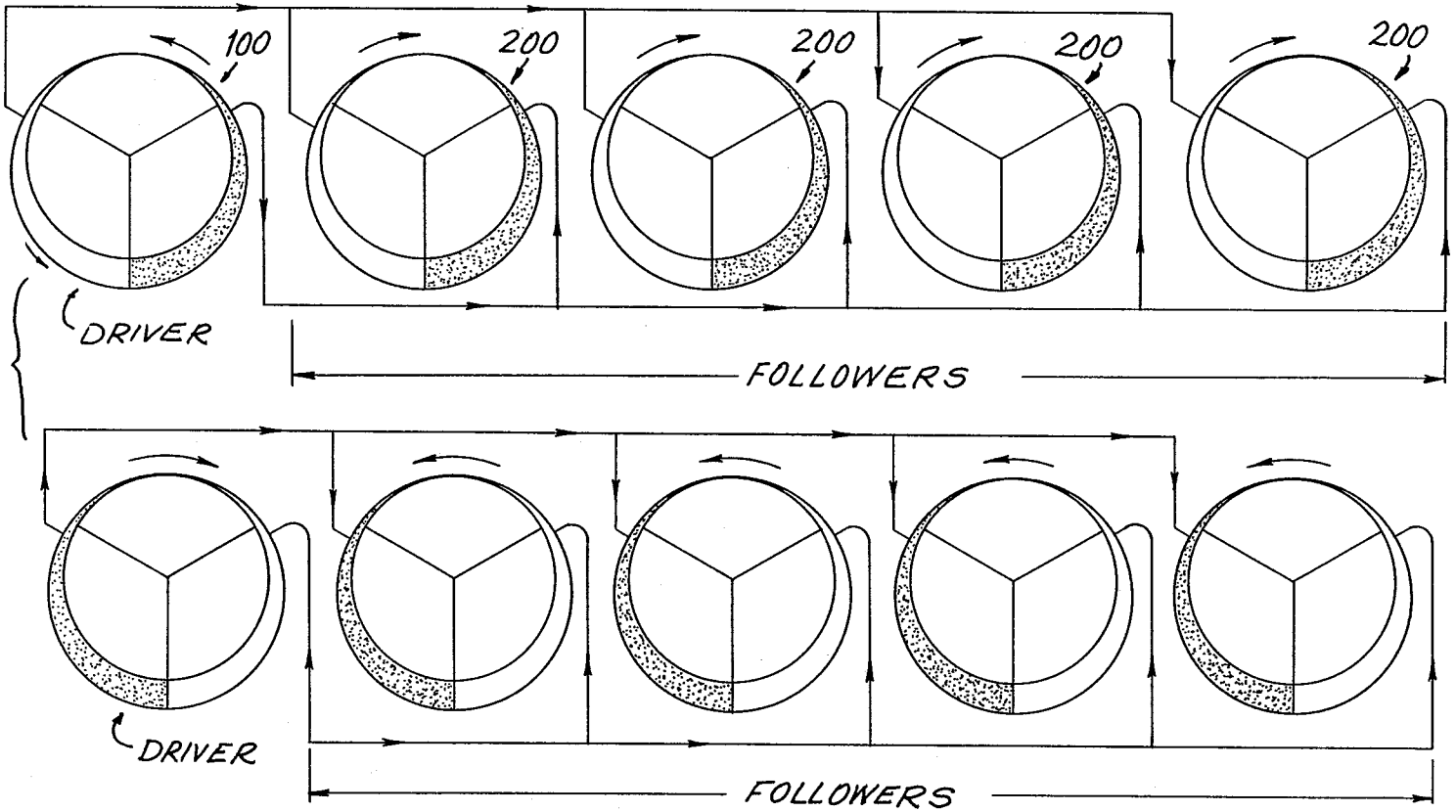
FIG. 25 is a schematic diagram showing five rotary units in accordance with the present invention, one of them serving as a drive power unit, four of them, each connected to a wheel, serving as the followers, or driven units.

Referring to FIG. 25, there is shown a schematic drawing for the operation of a single fluid pressure driver unit and four follower motor units. This system is one which can be applied to the operation of a motor vehicle, each of the four follower motor units being directly connected by the mechanical energy output shaft 3 to a wheel of the vehicle. In this manner, a four-wheel drive system is obtained without complex mechanical interconnection.

The direction of rotation of each driven wheel is also determined by the direction of rotation of the hydraulic drive unit. In the system depicted in FIG. 25, where the pressure side of each follower motor unit is shaded dark, as is the pressure side of the driver unit, when the driver operates in a counterclockwise rotation the follower motors will rotate in a clockwise rotation, and vice versa.

The outlet 90 from the driver unit 10 is in parallel fluid flow connection with the inlet 290 of each motor unit 200, via fluid flow lines 300, and the outlet 291 of each motor unit 200 is in parallel fluid flow connection with the inlet 91 of the driver unit 100. The fluid system is thus a closed, continuous flow system.

The driven motors 200 can be reversed in their direction of rotation by reversing the direction of rotation of the driver 100; this is readily accomplished by braking the driving shaft 3, and then reversing its direction of rotation. The driving shaft 3 can be linked, e.g., to a reversible electric motor.

Figure 23:
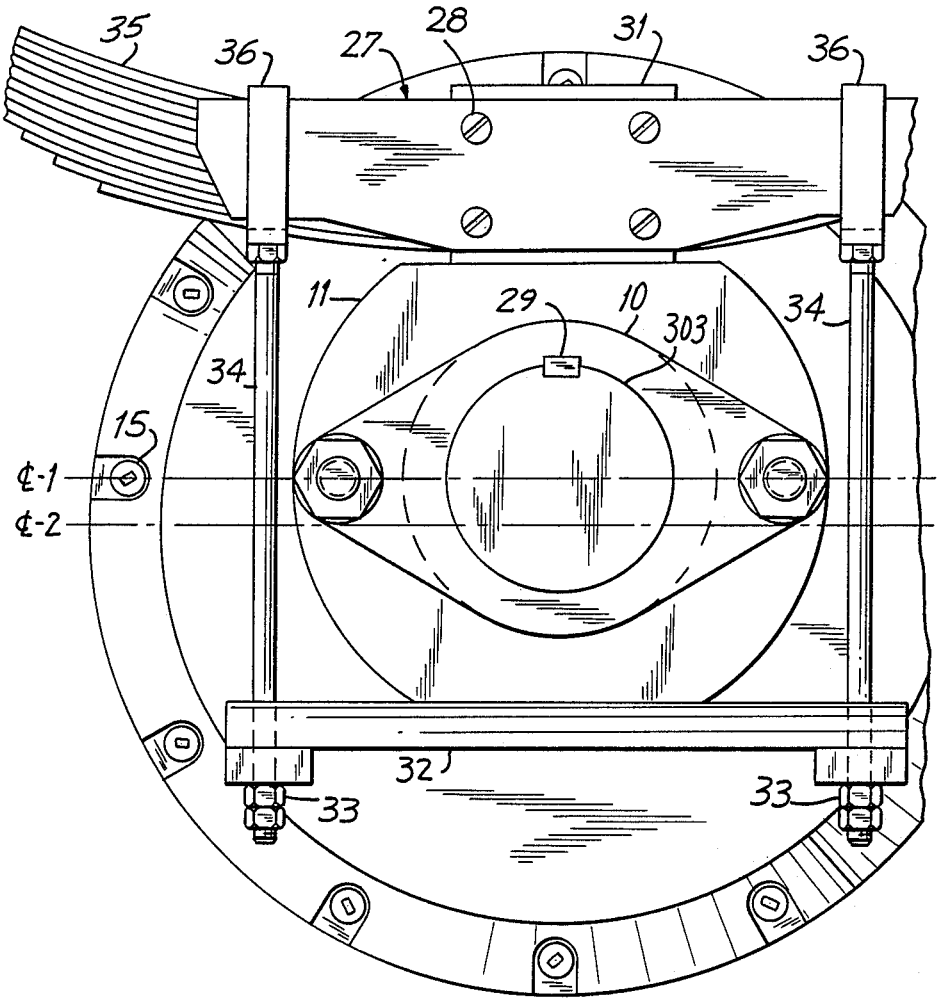
FIG. 23 is a front view showing a fluid drive unit of the present invention in place for driving a wheel of a wheeled vehicle.
Figure 24:
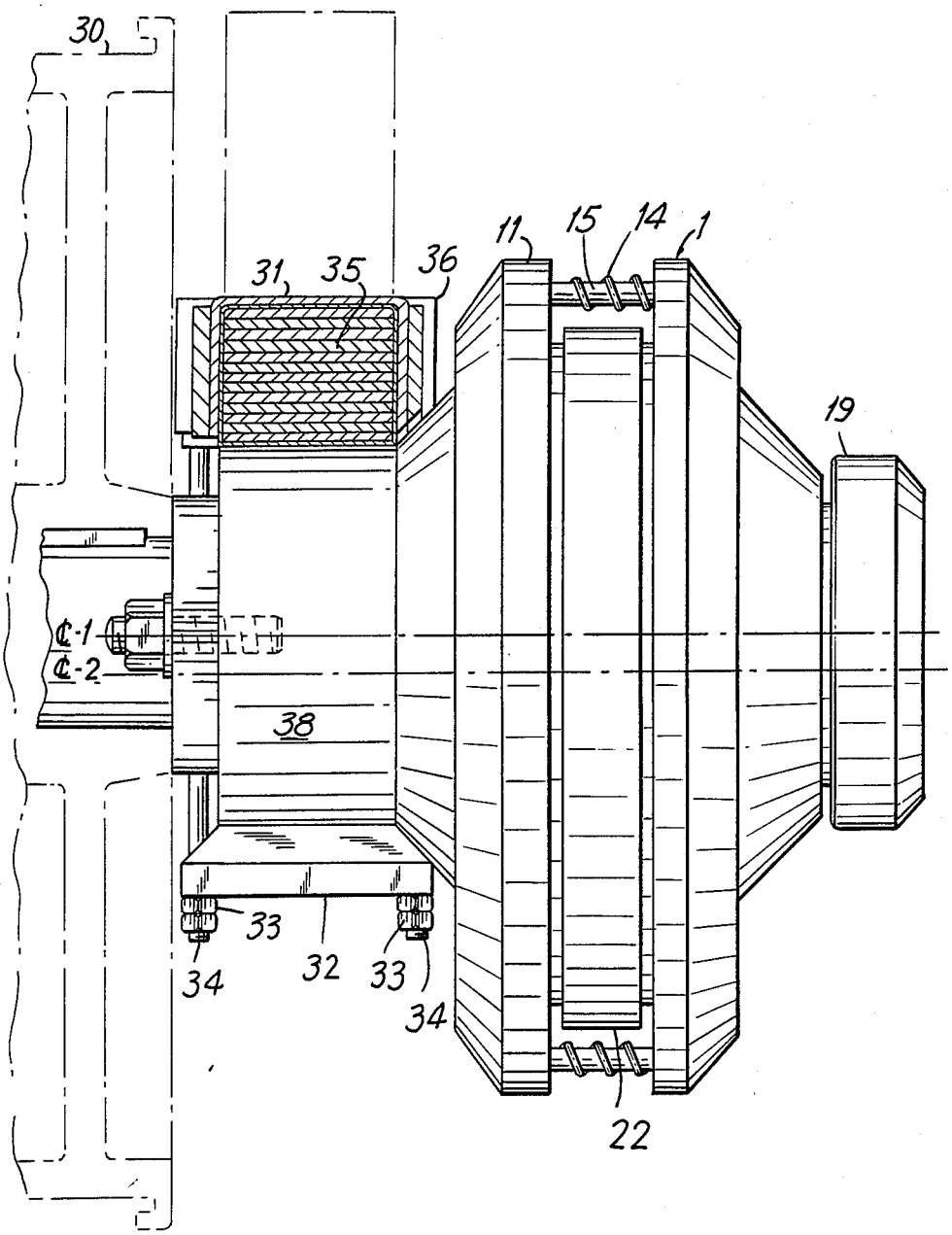
FIG. 24 is a side view of the vehicular drive of FIG. 23.

FIGS. 23 and 24 depict the mounting of a follower motor unit to the wheel of a motor vehicle. The front mechanical energy shaft 3 of the motor unit is connected directly, without intermediate gearing, to the axle of the wheel 30. The wheel is supported upon a bundle of leaf-springs 35 via a support system comprising a hanger 36, threaded rods 34, nuts 33, bottom bracket 32 and an upper bracket 27 holding the hanger 36. The bundle of leaf-springs 35 are surrounded by the upper bracket 27 and a U-bracket 31. The output shaft 3 from the fluid motor is connected to the wheel axle by a key 29.

The patentable embodiments of this invention which are claimed are as follows:

1. A positive displacement hydraulic rotator unit reversible in direction of rotation and capable of being used as a fluid driver unit or as a fluid driven motor, to provide a hydraulic power transmitter means, the rotator unit comprising a housing defining a substantially cylindrical internal chamber having an internal cylindrical surface, the internal chamber being centered about a first central axis; a rotor rotatably mounted within the chamber and rotatable about a second axis parallel to the first central axis but radially displaced therefrom; and an intake opening and an exhaust opening into the chamber through the internal cylindrical surface, the intake and exhaust openings being angularly displaced thereabout; the rotor comprising: a plurality of at least three arcuate core segments so juxtaposed one to the other as to define at least three radially extending, centrally interconnected blade channels between the core segments, the core segments having substantially coplanar, transverse side surfaces; a flange rigidly secured to the transverse sides of the core segments, the flange being substantially concentric with the core; rotor blades, having transverse side surfaces, slidably held within the blade channels so as to be radially reciprocally movable therewithin, the transverse sides of the core segments and of the blades being substantially coplanar; a rigid annular ring pinned to each of the blades to interconnect the several blades so that the blades and the annular ring are guided to rotate and to move radially as a single unit during rotation of the rotor, the inner diameter of the annular ring being greater than the outer diameter of the flange; and a transversely extending sealing surface secured to the radially outwardmost portion of each blade member, the blade members being so positioned and dimensioned as to maintain the sealing surface in sealable contact with the internal cylindrical surface and the inlet and outlet openings always separated by at least one such sealing surface; and a mechanical energy conducting member, secured concentrically to the core and extending axially outside of the unit to transmit mechanical energy.

2. A closed loop hydraulic motor system comprising a first hydraulic rotator unit in accordance with claim 1; a rotary power source; transmission means operably interconnecting the power source to the mechanical energy conducting member of the first rotator unit; a plurality of hydraulically driven hydraulic motor rotator units in accordance with claim 1; a hydraulic fluid transmission system designed to provide fluid pressure interconnection between the exhaust and the intake of the first rotator unit and the intake and exhaust respectively of each of the driven motor rotator units; and driven rotatable means operably secured to the mechanical energy conducting member of each motor rotator unit.

3. The rotator unit of claim 1 comprising blade pins and wherein the annular ring has a plurality of elongated holes therethrough, the holes being elongated in a radial direction, the ring being pinned to each of the blades by said blade pins extending through said elongated holes and into openings in the transverse side surfaces of the blades, to interconnect the several blades.

4. The rotator unit of claim 3 comprising a second flange, the first flange being a front flange and the second flange being a rear flange, the flanges being secured to the respective opposite transverse sides of the core segments, the flanges being substantially concentric with the core and having their largest dimension smaller than the inner diameter of the annular ring.

5. The rotator unit of claim 4 wherein the mechanical energy conducting member comprises at least one shaft, and wherein the shaft is rigidly secured to the front flange, the shaft extending transversely outward from the chamber.

6. The rotator unit of claim 5 wherein the core is annular, and further comprising central flange connecting means extending axially of the annular core and interconnecting the front and rear flanges, the core segments being each radially secured to the flange connecting means.

7. The rotary hydraulic unit of claim 6, wherein the core defines an interior central space, the radially inwardmost ends of the blades defining portions of said space.

8. The rotary hydraulic unit of claim 5 further comprising a shoe member pivotably secured to the radially outward end of each blade and having an outer curved surface which comprises the circumferentially extending sealing surface.

9. The rotator unit of claim 8 wherein the core has a circumferential surface and the core and each shoe member are so designed and juxtaposed that when a blade is located at its radially inwardmost position relative to the core, the shoe member is at least partially withdrawn into the core such that the sealing surface forms a substantially continuous curve with the circumferential surface of the core.

10. The rotator unit of claim 5 wherein the housing comprises two end housing portions and an annular central housing portion juxtaposed intermediate the two end housing portions; the central housing portion having a machined outer circumferential surface and a machined internal circumferential surface forming the internal cylindrical surface of the internal chamber; the first end housing portion comprising a machined internal cylindrical surface designed to form a close, slidable fit with one portion of the outer cylindrical surface of the central housing portion, and a centrally located opening designed to be in registry with and to surround the mechanical energy conducting member, forming a sealable fit therewith; the second end housing portion having a machined internal cylindrical surface designed to form a close slidable fit with a second portion of the cylindrical outer surface of the central housing portion, the two end portions each being provided with flange means; and further comprising spring bias connector means whereby the two end portions of the housing are drawn together around the central housing portion and the bias means tend to separate the two end housing portions countering the effect of the connecting means, the internal cylindrical surface of the end housing portions and the external cylindrical surface of the central housing portion forming a pressure tight seal for the internal chamber.

11. The rotary hydraulic unit of claim 1 in combination with a plurality of geometrically similar units and further comprising fluid flow conduits interconnecting the exhaust from the rotary hydraulic unit to the intakes of the geometrically similar units, and the exhausts of the geometrically similar units to the intake of the rotary hydraulic unit so as to form a closed hydraulic fluid loop, and means for connecting the mechanical energy conducting member on the rotary hydraulic unit to a source of mechanical energy, and means for connecting such mechanical energy conducting members on the geometrically similar units to provide a rotary power source.

12. The rotary hydraulic unit of claim 11 wherein the fluid flow conduits provide series flow connections between the rotary hydraulic unit and the geometrically similar units.

13. The rotary hydraulic unit of claim 12 wherein the fluid flow conduits provide parallel flow connections between the rotary hydraulic unit and the geometrically similar units.

14. A positive displacement hydraulic rotator unit, reversible in direction of rotation and capable of being used as a fluid driver unit or as a fluid driven motor, in a hydraulic power transmission system, the rotator unit comprising a housing defining a substantially cylindrical internal chamber having an internal cylindrical surface, the internal chamber being centered about a first central axis; a rotor rotatably mounted within the chamber and rotatable about a second axis parallel to the first central axis but radially displaced therefrom; and an intake opening and an exhaust opening into the chamber through the internal cylindrical surface, the intake and exhaust openings being angularly displaced thereabout; the rotor comprising a plurality of at least three arcuate core segments so juxtaposed one to the other as to define three radially extending centrally interconnected blade channels between the core segments, and a core segments connecting structure for rigidly securing the core segments together; rotor blades, having transverse side surfaces, slidably held within the blade channels so as to be radially reciprocally movable there within, the transverse sides of the core segments and of the blades being substantially coplanar; the core segment connecting structure comprising a front flange and a rear flange, the flanges being secured to the respective opposite transverse sides of the core segments, the flanges being substantially concentric with the core segments; blade pins; and annular ring having a plurality of elongated holes therethrough, the holes being elongated in a radial direction, the ring being pinned to each of the blades by said blade pins extending through such elongated holes and into openings in the transverse side surfaces of the blades, to interconnect the several blades so that the blades and the annular ring are guided to rotate and to move radially as a single unit during rotation of the rotor; the largest radial dimension of the flanges being smaller than the inner diameter of the annular ring; and a circumferentially extending sealing surface secured to the radially outwardmost portion of each blade member, the blade members being so positioned and dimensioned as to maintain the sealing surface in sealable contact with the inner cylindrical surface and the inlet and outlet openings always separated by at least one rotor blade; and a mechanical energy conducting member, secured concentrically to the core and extending axially outside of the unit to transmit mechanical energy.

* * * * *

UNITED STATES PATENT AND TRADEMARK OFFICE

CERTIFICATE OF CORRECTION

PATENT NO. : 4,947,646

DATED : August 14, 1990

INVENTOR(S) : Erwin Lenz

It is certified that error appears in the above-identified patent and that said Letters Patent is hereby corrected as shown below:

Column 10, Claim 14, line 34, before "annular" change "and" to --an--

Signed and Sealed this

Fifth Day of November, 1991

*Attest:*

HARRY F. MANBECK, JR.

*Attesting Officer*

*Commissioner of Patents and Trademarks*